US011802708B2

(12) United States Patent
Ishikawa

(10) Patent No.: US 11,802,708 B2
(45) Date of Patent: Oct. 31, 2023

(54) OUTDOOR UNIT, AIR CONDITIONER, AND OPERATION CONTROL METHOD FOR AIR CONDITIONER

(71) Applicant: Mitsubishi Electric Corporation, Tokyo (JP)

(72) Inventor: Atsushi Ishikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 188 days.

(21) Appl. No.: 17/606,937

(22) PCT Filed: May 20, 2019

(86) PCT No.: PCT/JP2019/019882

§ 371 (c)(1),
(2) Date: Oct. 27, 2021

(87) PCT Pub. No.: WO2020/234955

PCT Pub. Date: Nov. 26, 2020

(65) Prior Publication Data

US 2022/0235957 A1 Jul. 28, 2022

(51) Int. Cl.
*F24F 1/14* (2011.01)
*F24F 11/52* (2018.01)
(Continued)

(52) U.S. Cl.
CPC ..... *F24F 11/52* (2018.01); *F24F 1/14* (2013.01); *F24F 1/38* (2013.01); *F24F 2110/10* (2018.01)

(58) Field of Classification Search
CPC ..... F24F 11/52; F24F 1/14; F24F 1/38; F24F 2110/10; F24F 1/20; F24F 11/871;
(Continued)

(56) References Cited

U.S. PATENT DOCUMENTS 11,128,147 B2 * 9/2021 Ballantine ..... H02J 3/14
2015/0168012 A1 * 6/2015 Amberson ..... F24H 9/1863 392/377

(Continued)

FOREIGN PATENT DOCUMENTS

CN 101387455 A 3/2009
CN 104501350 A 4/2015

(Continued)

OTHER PUBLICATIONS

Office Action dated Jul. 19, 2022 in connection with counterpart Japanese Patent Application No. 2021-520519 (and English machine translation).

(Continued)

*Primary Examiner* — Alicia M. Choi
(74) *Attorney, Agent, or Firm* — POSZ LAW GROUP, PLC

(57) ABSTRACT

An outdoor unit includes a heat exchanger, a fan having a motor having coils to blow air to the heat exchanger, a connection switching unit to switch a connection state of the coils between a first connection state and a second connection state in which a line voltage is lower than a line voltage in the first connection state, and a temperature sensor to detect a temperature. When the motor is not driven, the connection switching unit sets the connection state of the coils to the second connection state. When the motor rotates, the connection switching unit sets the connection state of the coils to the first connection state if a detected temperature by the temperature sensor is higher than or equal to a threshold, and the connection switching unit sets the connection state of the coils to the second connection state if the detected temperature is lower than the threshold.

17 Claims, 17 Drawing Sheets

(51) Int. Cl.
*F24F 1/38* (2011.01)
*F24F 110/10* (2018.01)

(58) Field of Classification Search
CPC . F24F 11/88; F24F 11/30; F24F 11/86; Y02B 30/70; F25B 13/00; F25B 49/02; H02P 25/18; H02P 23/00
See application file for complete search history.

(56) References Cited

U.S. PATENT DOCUMENTS

| | | | | |
|---|---|---|---|---|
| 2015/0251766 | A1* | 9/2015 | Atkey | F25B 27/00 60/785 |
| 2016/0134224 | A1* | 5/2016 | Bock | G01K 7/00 318/473 |
| 2017/0268797 | A1* | 9/2017 | Mowris | G05D 23/1951 |
| 2019/0245470 | A1 | 8/2019 | Nigo | |
| 2019/0245471 | A1 | 8/2019 | Nigo | |
| 2020/0186073 | A1 | 6/2020 | Nigo et al. | |
| 2020/0217543 | A1 | 7/2020 | Sakabe et al. | |

FOREIGN PATENT DOCUMENTS

| | | | | |
|---|---|---|---|---|
| CN | 206225995 | U | | 6/2017 |
| CN | 108431528 | A | | 8/2018 |
| EP | 3 258 190 | A1 | | 12/2017 |
| JP | 2006342738 | A | * | 12/2006 |
| JP | 2008228513 | A | * | 9/2008 |
| JP | 2009216324 | A | * | 9/2009 |
| JP | 2011-250692 | A | | 12/2011 |
| JP | 2016099029 | A | * | 5/2016 |
| JP | 2018-014829 | A | | 1/2018 |
| JP | 2018014829 | A | * | 1/2018 |
| JP | 2018-057114 | A | | 4/2018 |
| KR | 20010010055 | A | * | 2/2001 |
| WO | 2018/078835 | A1 | | 5/2018 |
| WO | 2018/078845 | A1 | | 5/2018 |
| WO | 2019/021374 | A1 | | 1/2019 |
| WO | 2019/021450 | A1 | | 1/2019 |
| WO | 2019/035198 | A1 | | 2/2019 |

OTHER PUBLICATIONS

Office Action dated May 8, 2023 in connection with counterpart Chinese Patent Application No. 201980095842.0 (and English machine translation).

Office Action dated Nov. 24, 2022 in corresponding CN Patent Application No. 201980095842.0 (with machine English translation).

International Search Report of the International Searching Authority dated Jun. 25, 2019 for the corresponding International application No. PCT/JP2019/019882 (and English translation).

Office Action dated Jul. 4, 2022 in connection with counterpart Chinese Patent Application No. 201980095842.0 (and English machine translation).

Office Action dated Jan. 17, 2023 in connection with counterpart Japanese Patent Application No. 2021-520519 (and English machine translation).

Office Action (Decision of refusal) dated Jul. 13, 2023 in connection with counterpart Chinese Patent Application No. 201980095842.0 (and English machine translation).

* cited by examiner

OUTDOOR UNIT, AIR CONDITIONER, AND OPERATION CONTROL METHOD FOR AIR CONDITIONER

CROSS REFERENCE TO RELATED APPLICATION

This application is a U.S. national stage application of International Patent Application No. PCT/JP2019/019882 filed on May 20, 2019, the disclosure of which is incorporated herein by reference.

TECHNICAL FIELD

The present invention relates to an outdoor unit, an air conditioner, and an operation control method for the air conditioner.

BACKGROUND

A motor is used as a drive source of a fan in an outdoor unit of an air conditioner. In recent years, it has been proposed to switch the connection state of coils of the motor between a Y-connection and a delta-connection (see, for example, Patent Reference 1).

PATENT REFERENCE

[PATENT REFERENCE 1] Japanese Patent Application Publication No. 2018-057114 (see FIG. 1)

In the outdoor unit, the outside wind may cause the fan to rotate even when the fan is not driven. When the outside wind causes the fan to rotate, the motor acts as a generator, so that an induced voltage is generated. For this reason, the number of turns of the coils in the motor is restricted so that the induced voltage at this time does not exceed a withstand voltage of a drive circuit of the motor. Meanwhile, in order to improve the operation efficiency of the motor, it is necessary to increase the number of turns of the coils. Thus, if the number of turns of the coils is restricted as described above, it may hinder the improvement in the operation efficiency of the motor.

Further, when the outside temperature is low, there occurs a phenomenon called frost formation, in which moisture in the air adheres to fins of a heat exchanger provided in the outdoor unit and then freezes. When frost formation occurs, a ventilation resistance of the fins increases, and the operation capacity of the heat exchanger decreases. Therefore, when the frost formation occurs, it is necessary to increase a rotation speed of the motor to thereby increase a blowing air volume.

However, a motor voltage cannot exceed the maximum voltage defined by a voltage of a commercial power source. When the number of turns of coils is increased to improve the operation efficiency of the motor, the motor voltage is more likely to reach the maximum voltage, and thus it is difficult to increase the blowing air volume in case of frost formation.

SUMMARY

The present invention is intended to solve the above-described problem, and an object of the present invention is to improve the operation efficiency of a motor, to suppress an increase in an induced voltage due to the outside wind, and to enable an increase in the blowing air volume in case of frost formation.

An outdoor unit of the present invention includes a heat exchanger, a fan having a motor having coils, the fan blowing air to the heat exchanger, a connection switching unit to switch a connection state of the coils between a first connection state and a second connection state in which a line voltage is lower than a line voltage in the first connection state, and a temperature sensor to detect a temperature. When the motor is not driven, the connection switching unit sets the connection state of the coils to the second connection state. When the motor rotates, the connection switching unit sets the connection state of the coils to the first connection state if a detected temperature by the temperature sensor is higher than or equal to a threshold, and the connection switching unit sets the connection state of the coils to the second connection state if the detected temperature is lower than the threshold.

According to the present invention, since the connection state of the coils is the second connection state when the motor is not driven, an increase in the induced voltage when the outside wind causes the motor to rotate is suppressed. Thus, the number of turns of the coils can be increased, and the operation efficiency of the motor can be improved. Since the connection state of the coils is switched based on the comparison result between the detected temperature by the temperature sensor and the threshold, the blowing air volume can be increased while the increase in the induced voltage can be suppressed at a temperature at which frost formation is more likely to occur, whereas the operation efficiency of the motor can be improved at a temperature at which frost formation is less likely to occur.

DETAILED DESCRIPTION

Embodiments of the present invention will be described in detail below with reference to the figures. The present invention is not limited to these embodiments.

First Embodiment (Configuration of Motor)

Figure 1:
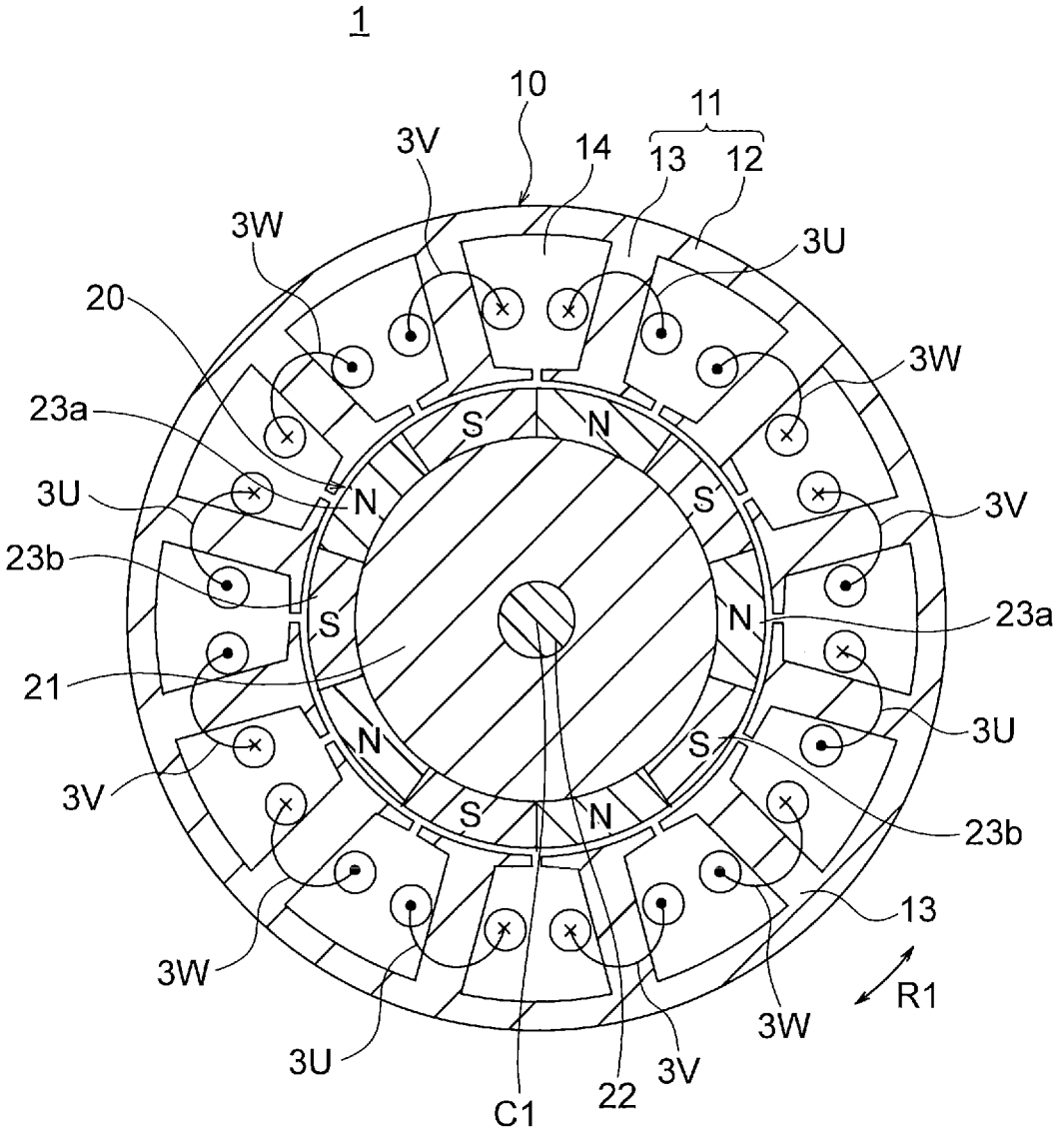
FIG. 1 is a sectional view illustrating a motor of a first embodiment.

FIG. 1 is a sectional view illustrating a motor 1 used in an outdoor unit of an air conditioner of a first embodiment. The motor 1 includes a stator 10 and a rotor 20 rotatably provided inside the stator 10. An air gap of, for example, 0.3 to 1.0 mm, is famed between the stator 10 and the rotor 20.

Hereinafter, an axis that defines a rotational axis of the rotor 20 is referred to as an axis C1. A direction of the axis C1 is referred to as an "axial direction". A circumferential direction about the axis C1 is referred to as a "circumferential direction". A radial direction about the axis C1 is referred to as a "radial direction". FIG. 1 is a sectional view in a plane perpendicular to the axis C1.

The stator 10 includes a stator core 11 and coils 3 wound around the stator core 11. The stator core 11 is formed of a plurality of electromagnetic steel sheets, each having a thickness of 0.2 to 0.5 mm, which are stacked in the axial direction and fastened by crimping or the like.

The stator core 11 has an annular yoke 12 and a plurality of teeth 13 protruding inward in the radial direction from the yoke 12. The number of teeth 13 is twelve in this example. The number of teeth 13 is not limited to twelve, and only needs to be two or more. Each tooth 13 has a tooth tip portion at its tip on the inner side in the radial direction, and the tooth tip portion is wide in the circumferential direction.

The coils 3 are wound around the teeth 13 via insulators (not shown). Each coil 3 is formed of a conductive wire made of aluminum or copper, for example, and is wound around the tooth 13 in concentrated winding. More specifically, the coil 3 is formed of a magnet wire having a wire diameter (diameter) of 0.2 to 0.5 mm.

The coils 3 are formed of a U-phase coil 3U, a V-phase coil 3V, and a W-phase coil 3W. Both terminals of each of the coils 3U, 3V, and 3W are open. In other words, the coils 3 have six terminals in total. The connection state of the coils 3 can be switched between a Y-connection and a delta-connection, as described below.

The rotor 20 includes a cylindrical rotor core 21, a shaft 22 attached to a center of the rotor core 21, and permanent magnets 23*a* and 23*b* attached to an outer circumference of the rotor core 21.

The rotor core 21 is famed of a plurality of electromagnetic steel sheets, each having a thickness of 0.2 to 0.5 mm, which are stacked in the axial direction and fastened by crimping or the like. A shaft hole to which the shaft 22 is fixed is formed at the center of the rotor core 21 in the radial direction. The shaft 22 is fixed to the shaft hole by shrink-fitting, press-fitting, or the like.

The permanent magnets 23*a* and 23*b* are alternately arranged in the circumferential direction. Here, the permanent magnets 23*a* are N-poles, and the permanent magnets 23*b* are S-poles. There are five permanent magnets 23*a* and five permanent magnets 23*b*, and therefore the number of poles is 10. In this regard, the number of poles is not limited to 10. Each of the permanent magnets 23*a* and 23*b* is made of a rare earth magnet that contains, for example, neodymium (Nd), iron (Fe), and boron (B).

The motor in which the permanent magnets 23*a* and 23*b* are fixed to the surface of the rotor core 21 is referred to as a Surface Permanent Magnet (SPM) type motor. However, the motor 1 is not limited to the SPM type, but may be an Inner Permanent Magnet (IPM) type motor in which permanent magnets 23 are embedded in magnet insertion holes of the rotor core 21.

(Configuration of Air Conditioner)

Figure 2:
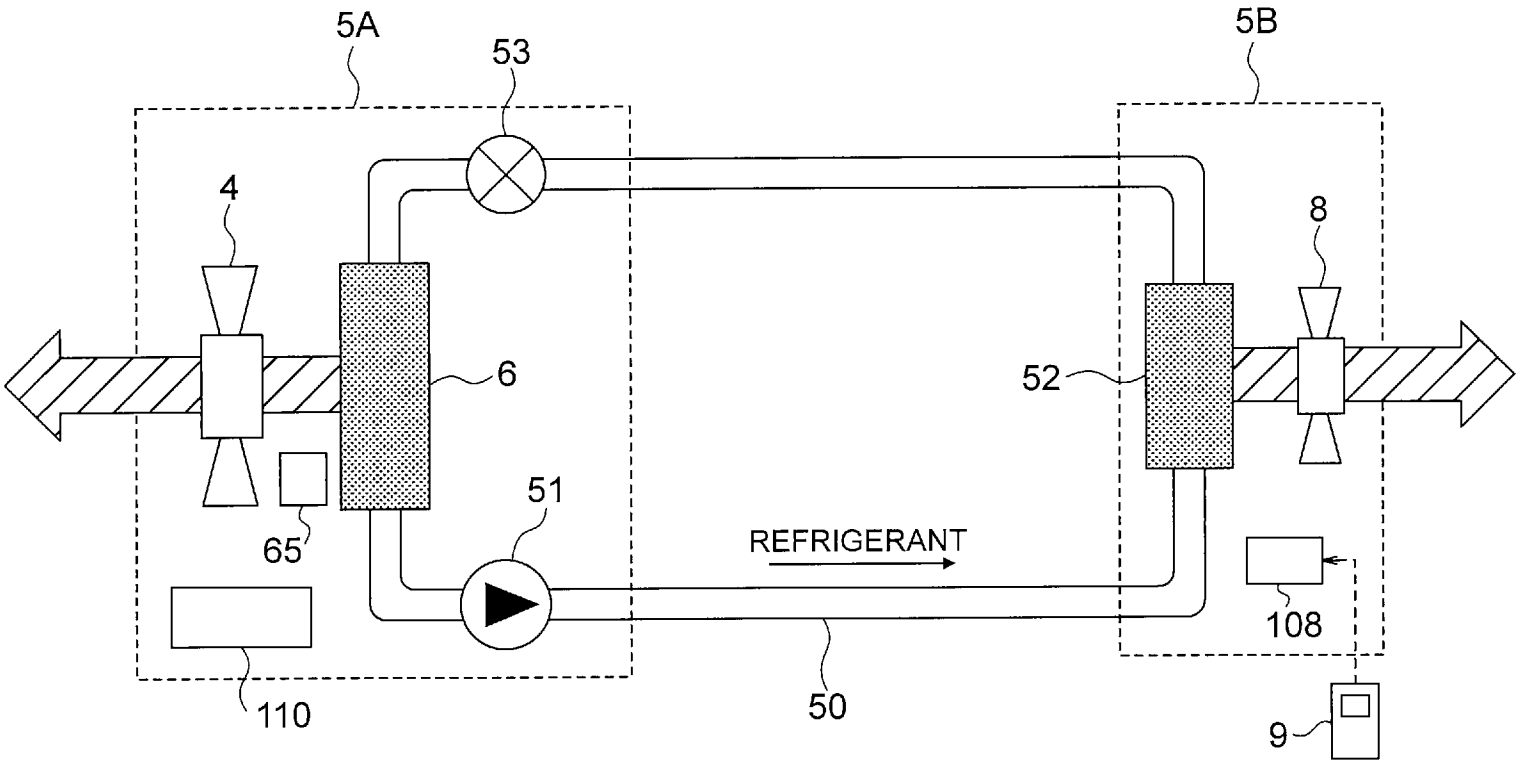
FIG. 2 is a schematic diagram illustrating an air conditioner of the first embodiment.

FIG. 2 is a schematic diagram illustrating an air conditioner 5 of the first embodiment. The air conditioner 5 includes an outdoor unit 5A installed outdoors and an indoor unit 5B installed in a room to be air-conditioned. The outdoor unit 5A and the indoor unit 5B are connected by a refrigerant pipe 50.

The air conditioner 5 includes a compressor 51 that compresses and discharges a refrigerant, an indoor heat exchanger 52 that exchanges heat between the refrigerant and indoor air, an expansion valve 53 as a decompressor that depressurizes the refrigerant, and an outdoor heat exchanger 6 as a heat exchanger that exchanges heat between the refrigerant and outdoor air. The compressor 51, the indoor heat exchanger 52, the expansion valve 53, and the outdoor heat exchanger 6 are connected by the refrigerant pipe 50 to constitute a refrigerant circuit.

In a heating operation, the refrigerant discharged from the compressor 51 flows through the indoor heat exchanger 52, the expansion valve 53, and the outdoor heat exchanger 6 in this order. In a cooling operation, the flow path is switched to the opposite direction by a refrigerant flow path switching valve (four-way valve) not illustrated.

The outdoor unit 5A includes the compressor 51 and the outdoor heat exchanger 6 which are described above, and an outdoor fan 4 as a fan. The outdoor fan 4 blows air to the outdoor heat exchanger 6. The outdoor unit 5A further includes a controller 110 that controls the operation of the air conditioner 5.

The indoor unit 5B includes the indoor heat exchanger 52 described above and an indoor fan 8. The indoor fan 8 supplies air subjected to heat exchange in the indoor heat exchanger 52, to the inside of the room. The indoor unit 5B further includes a signal receiver 108 that receives a signal transmitted from a remote controller 9 as an operating device.

In the heating operation, a high-temperature and high-pressure gas refrigerant discharged from the compressor 51 flows through the refrigerant pipe 50 and flows into the indoor heat exchanger 52 of the indoor unit 5B. The indoor heat exchanger 52 operates as a condenser. When the air blown by the indoor fan 8 passes through the indoor heat exchanger 52, condensation heat is transmitted from the refrigerant to the air by heat exchange, and the heated air is supplied into the inside of the room. The refrigerant is condensed into a high-pressure and low-temperature liquid refrigerant, and flows into the expansion valve 53 of the outdoor unit 5A through the refrigerant pipe 50. The refrigerant expands adiabatically in the expansion valve 53 to be a low-pressure and low-temperature, two-phase refrigerant.

The refrigerant passing through the expansion valve 53 flows into the outdoor heat exchanger 6. The outdoor heat exchanger 6 operates as an evaporator. When the air blown by the outdoor fan 4 passes through the outdoor heat exchanger 6, evaporative heat is transmitted from the air to the refrigerant by heat exchange. The refrigerant evaporates to be a low-temperature and low-pressure gas refrigerant, and is then compressed by the compressor 51 again into a high-temperature and high-pressure refrigerant.

Figure 3B:
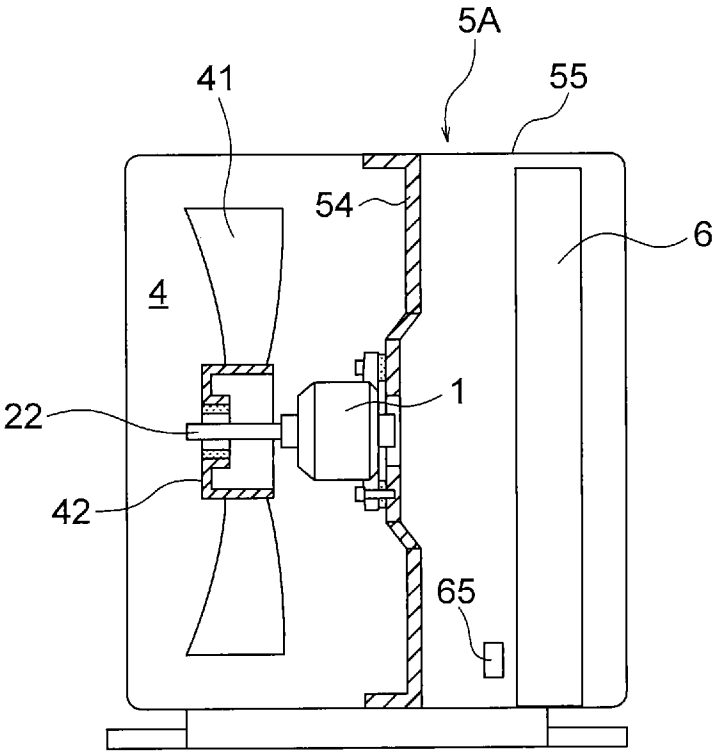
FIG. 3(B) is a sectional view illustrating an outdoor fan.
Figure 3A:
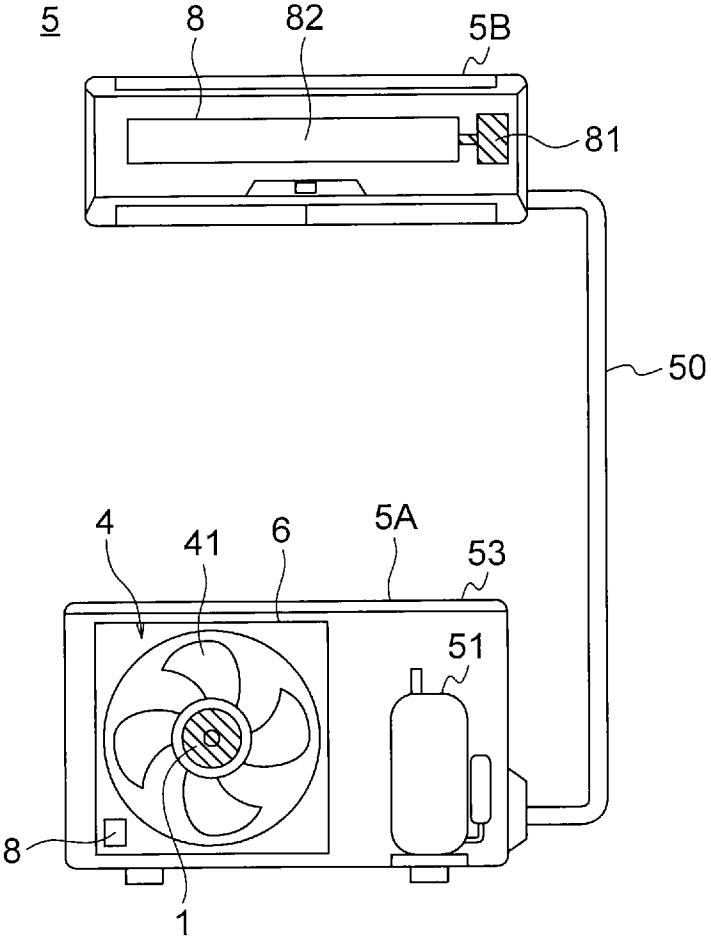
FIG. 3(A) is a diagram illustrating the air conditioner of the first embodiment.

FIG. 3(A) is a schematic diagram illustrating components of the outdoor unit 5A and the indoor unit 5B. The outdoor fan 4 of the outdoor unit 5A includes an impeller 41 and the motor 1 that rotates the impeller 41. The motor 1 has the configuration described with reference to FIG. 1. The impeller 41 is fixed to the shaft 22 of the motor 1 by a hub 42.

FIG. 3(B) is a sectional view illustrating the outdoor unit 5A. The outdoor heat exchanger 6 is disposed to face the outdoor fan 4 in the axial direction of the motor 1. When the outdoor fan 4 blows air, an airflow passing through the outdoor heat exchanger 6 is generated. The outdoor heat exchanger 6 does not necessarily face the outdoor fan 4, but only needs to be in an air passage of the outdoor fan 4.

The outdoor unit 5A also has a fin temperature sensor 65 serving as a temperature sensor for measuring a surface temperature of fins 61 (FIG. 4) of the outdoor heat exchanger 6. The fin temperature sensor 65 is formed of a thermistor, for example. However, other sensors than the thermistor may be used.

The indoor fan 8 of the indoor unit 5B includes an impeller 82 and a motor 81 that rotates the impeller 82. The impeller 82 is composed of, for example, a cross flow fan. The motor 81 may have the same configuration as the motor 1 (FIG. 1) of the outdoor fan 4, but is not limited thereto. When the indoor fan 8 blows air, an airflow passing through the indoor heat exchanger 52 (FIG. 2) is generated.

Figure 4:
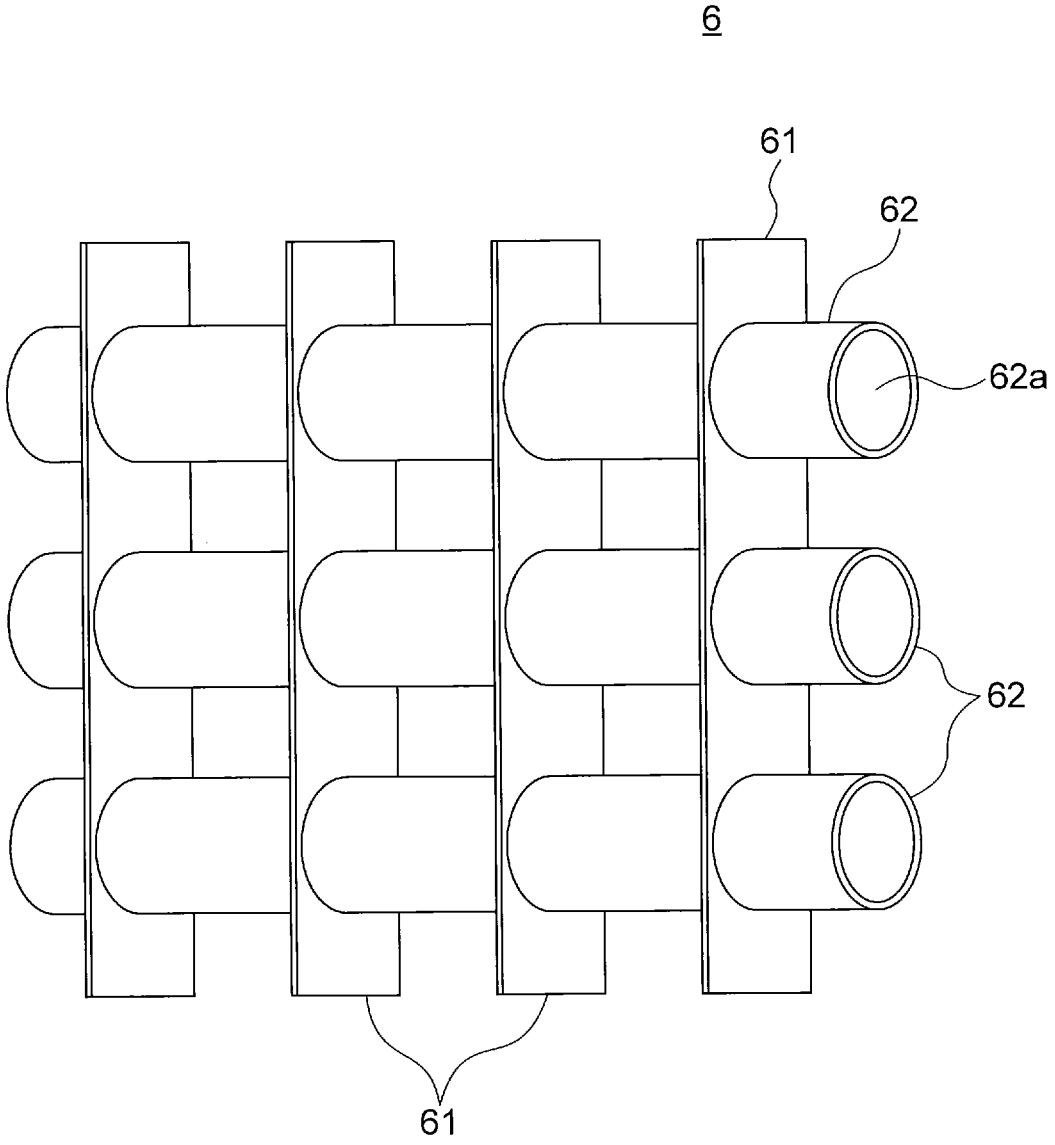
FIG. 4 is a schematic diagram illustrating a part of a heat exchanger of an outdoor unit of the first embodiment.

FIG. 4 is an enlarged schematic diagram illustrating a part of the outdoor heat exchanger 6. The outdoor heat exchanger 6 is, for example, a fin-and-tube heat exchanger. Specifically, the outdoor heat exchanger 6 has a plurality of fins 61 that are elongated in the vertical direction and are arranged at equal intervals in the horizontal direction in FIG. 4. Each fin 61 has a flat-plate shape and is famed of a metal such as aluminum.

Each fin 61 has a plurality of holes famed at equal intervals in the longitudinal direction, and heat transfer tubes 62 are inserted into the holes. The heat transfer tubes 62 are elongated in the direction perpendicular to the longitudinal direction of the fins 61 and are arranged at equal intervals in the direction perpendicular to the arrangement direction of the fins 61. Each heat transfer tube 62 is a tube in which a flow path 62*a* for a refrigerant is formed. The heat transfer tube 62 is formed of a metal such as aluminum. The fins 61 and the heat transfer tubes 62 are desirably arranged in a plane perpendicular to the axial direction of the motor 1.

Heat exchange is carried out between the air flowing through between adjacent fins 61 and the refrigerant flowing in the heat transfer tubes 62. The numbers of fins 61 and heat transfer tubes 62 are determined according to the capacity required for the outdoor heat exchanger 6. The configuration of the fins 61 illustrated in FIG. 4 is merely an example, and any fins having other configurations may be used.

(Configuration of Drive Device)

Figure 5:
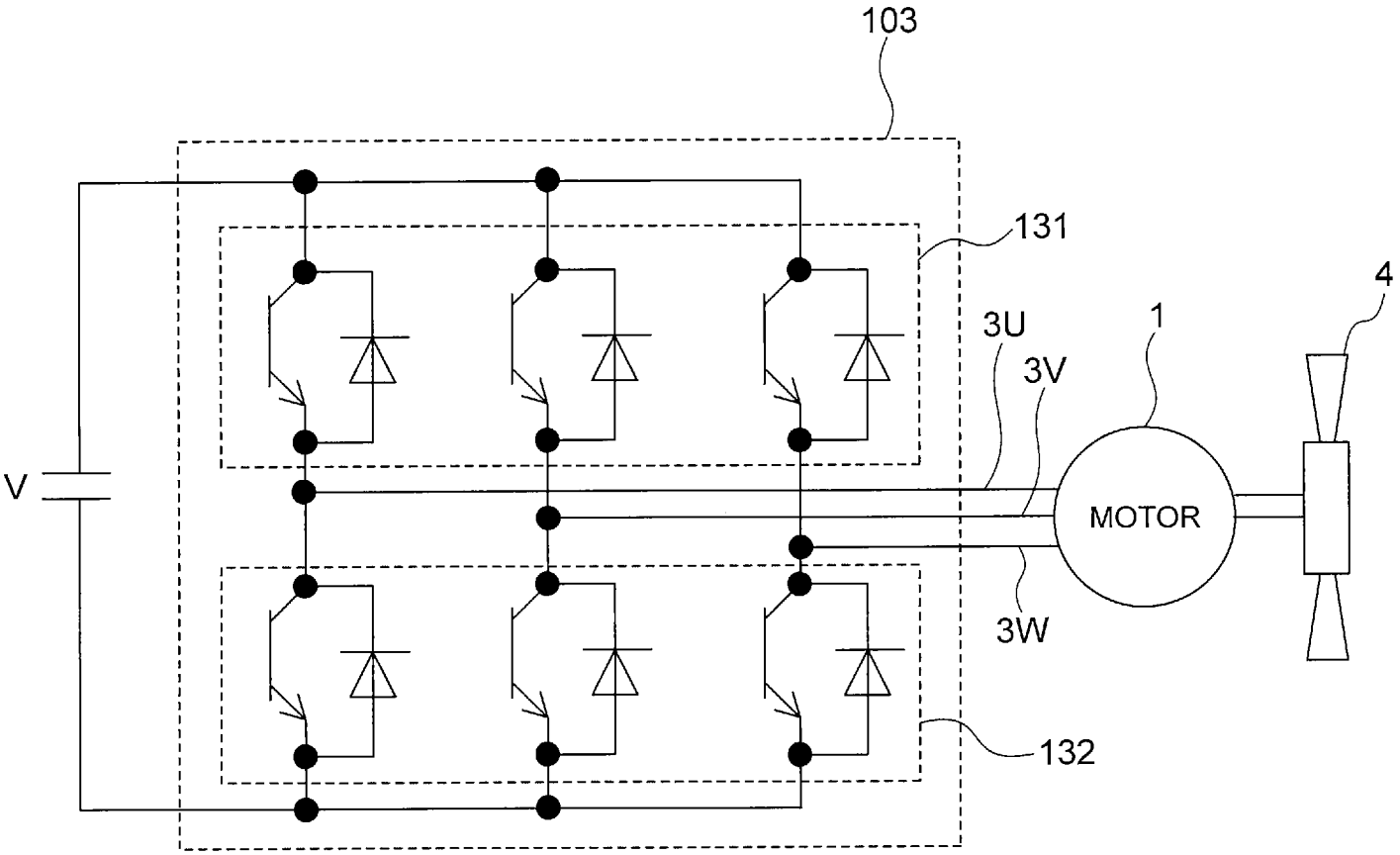
FIG. 5 is a block diagram illustrating the motor and an inverter of the first embodiment.

FIG. 5 is a block diagram illustrating the motor 1 and an inverter 103 that drives the motor 1. The inverter 103 converts an input voltage V, which is a DC voltage, into an AC voltage, and outputs the AC voltage to the coils 3U, 3V, and 3W of the motor 1.

The inverter 103 has an upper arm 131 and a lower arm 132. Each of the upper arm 131 and the lower arm 132 has U-phase, V-phase, and W-phase switching elements. These U-, V-, and W-phase switching elements are subjected to Pulse Width Modulation (PWM) control by a control signal from the controller 110 (FIG. 6).

Figure 6:
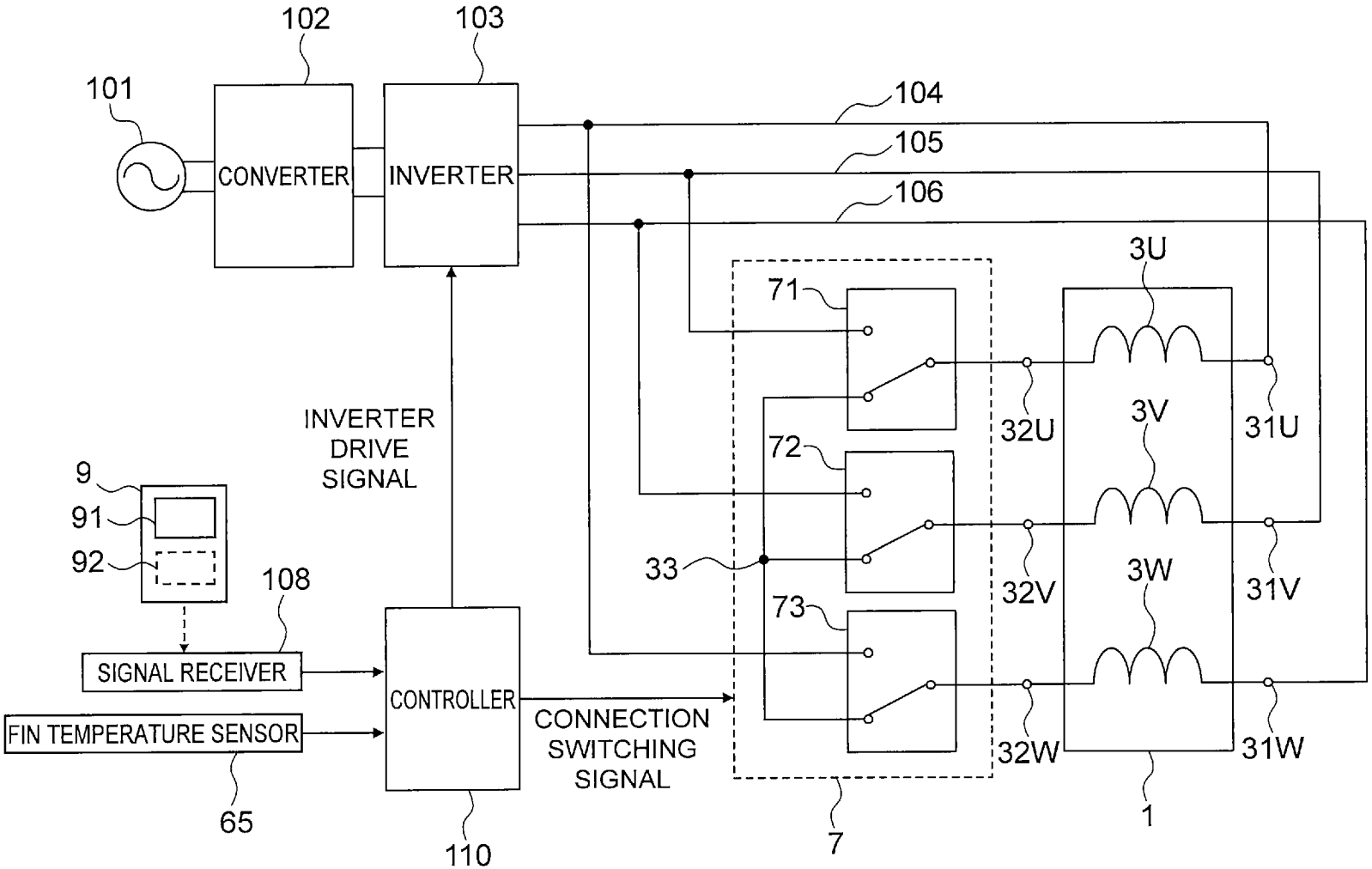
FIG. 6 is a block diagram illustrating a drive device that drives the motor of the first embodiment.

FIG. 6 is a block diagram illustrating a drive device 100 including the above-described inverter 103. The drive device 100 includes a converter 102 that rectifies an output from a power source 101, the inverter 103 that outputs an AC voltage to the coils 3 of the motor 1, a connection switching unit 7 that switches the connection state of the coils 3, and the controller 110.

The power source 101 is an AC power source of, for example, 200 V (effective voltage), and specifically is, for example, a commercial power source. The converter 102 is a rectifier circuit that converts the AC voltage supplied from the power source 101 into a DC voltage. The voltage output from the converter 102 is also referred to as a bus voltage.

The inverter 103 has the configuration described with reference to FIG. 5. The inverter 103 is supplied with a bus voltage from the converter 102 and outputs a line voltage (also referred to as a motor voltage) to the coils 3 of the motor 1. The inverter 103 is connected to wirings 104, 105, and 106 that are connected to the coils 3U, 3V, and 3W, respectively.

The coil 3U has terminals 31U and 32U. The coil 3V has terminals 31V and 32V. The coil 3W has terminals 31W and 32W. The wiring 104 is connected to the terminal 31U of the coil 3U. The wiring 105 is connected to the terminal 31V of the coil 3V. The wiring 106 is connected to the terminal 31W of the coil 3W.

The connection switching unit 7 has switching elements 71, 72, and 73. The switching element 71 connects the terminal 32U of the coil 3U to either the wiring 105 or a neutral point 33. The switching element 72 connects the terminal 32V of the coil 3V to either the wiring 106 or the neutral point 33. The switching element 73 connects the terminal 32W of the coil 3W to either the wiring 104 or the neutral point 33. Each of the switching elements 71, 72, and 73 are configured as a mechanical switch, i.e., a relay contact in this example. However, each of the switching elements 71, 72, and 73 may also be configured as a semiconductor switch.

The controller 110 controls the converter 102, the inverter 103, and the connection switching unit 7. An operation instruction signal from the remote controller 9 received by the signal receiver 108 of the indoor unit 5B, information about a surface temperature of the fins 61 detected by the fin temperature sensor 65, and an indoor temperature detected by an indoor temperature sensor are input to the controller 110.

The remote controller 9 includes a display 91 and an operation section 92. The display 91 is, for example, a liquid crystal display, and displays an operation state of the air conditioner 5 or a menu screen. The operation section 92 is, for example, keys or the like, with which start and stop of the air conditioner 5, switching between operation modes, and setting of operation contents are performed. The operation modes include, for example, the heating operation and the cooling operation. The operation contents include, for example, a set temperature and a wind speed.

Based on these input information, the controller 110 outputs an inverter drive signal to the inverter 103 and a connection switching signal to the connection switching unit 7.

In the state illustrated in FIG. 6, the switching element 71 connects the terminal 32U of the coil 3U to the neutral point 33, the switching element 72 connects the terminal 32V of the coil 3V to the neutral point 33, and the switching element 73 connects the terminal 32W of the coil 3W to the neutral point 33. That is, the terminals 31U, 31V, and 31W of the coils 3U, 3V, and 3W are connected to the inverter 103, while the terminals 32U, 32V, and 32W are connected to the neutral point 33.

Figure 7:
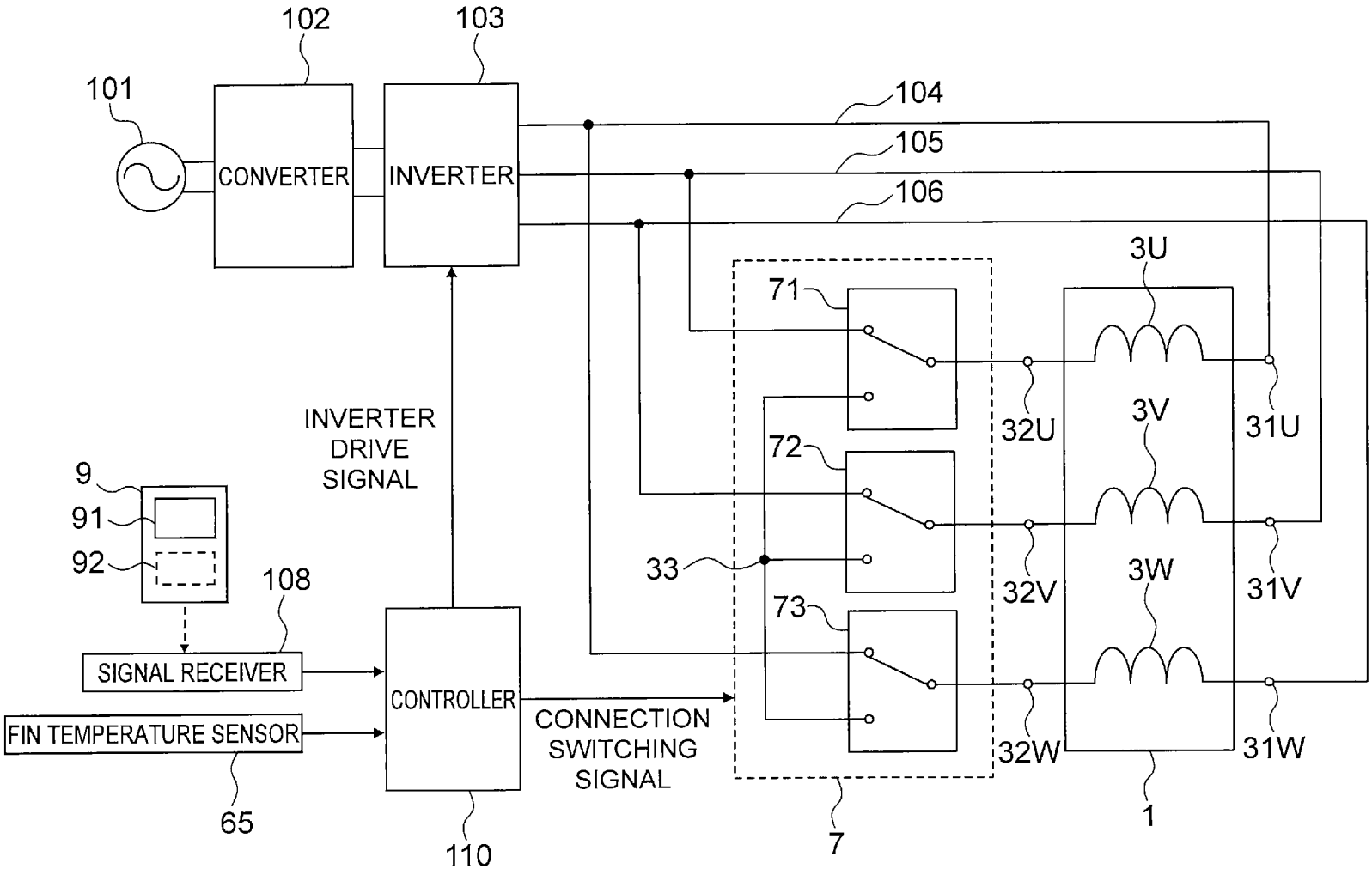
FIG. 7 is a block diagram illustrating the drive device that drives the motor of the first embodiment.

FIG. 7 is a block diagram illustrating a state of the drive device 100 in which the switching elements 71, 72, and 73 of the connection switching unit 7 are switched. In the state illustrated in FIG. 7, the switching element 71 connects the terminal 32U of the coil 3U to the wiring 105, the switching element 72 connects the terminal 32V of the coil 3V to the wiring 106, and the switching element 73 connects the terminal 32W of the coil 3W to the wiring 104.

Figure 8A:
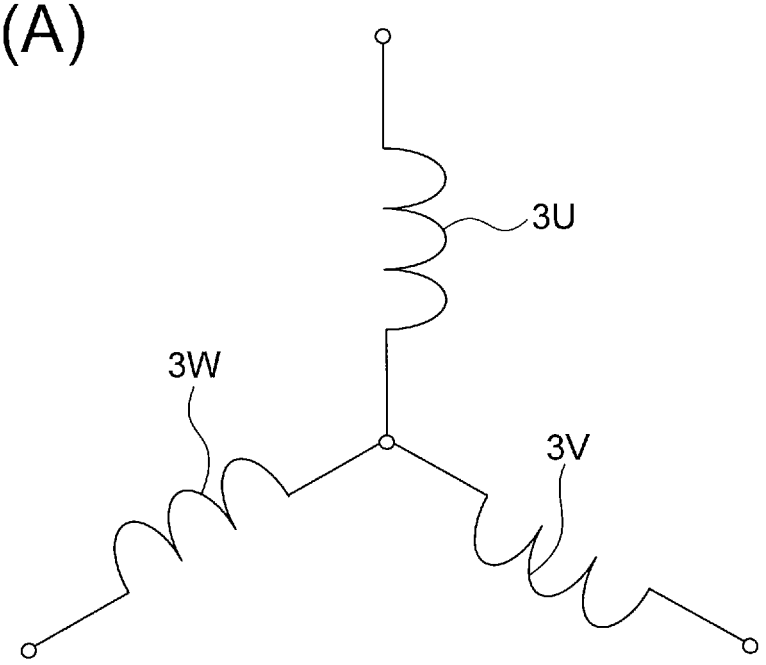
FIGS. 8(A) and 8(B) are schematic diagrams illustrating connection states of coils of the first embodiment.

FIG. 8(A) is a schematic diagram illustrating the connection state of the coils 3U, 3V, and 3W when the switching elements 71, 72, and 73 are in the state illustrated in FIG. 6. The coils 3U, 3V, and 3W are connected to the neutral point 33 at the terminals 32U, 32V, and 32W, respectively. Therefore, the connection state of the coils 3U, 3V, and 3W is the Y-connection (star connection).

Figure 8B:
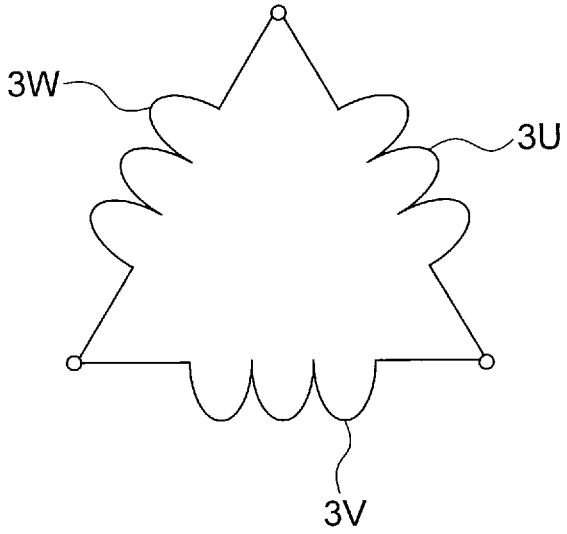

FIG. 8(B) is a schematic diagram illustrating the connection state of the coils 3U, 3V, and 3W when the switching elements 71, 72, and 73 are in the state illustrated in FIG. 7. The terminal 32U of the coil 3U is connected to the terminal 31V of the coil 3V via the wiring 105 (FIG. 7). The terminal 32V of the coil 3V is connected to the terminal 31W of the coil 3W via the wiring 106 (FIG. 7). The terminal 32W of the coil 3W is connected to the terminal 31U of the coil 3U via the wiring 104 (FIG. 7). Therefore, the connection state of the coils 3U, 3V, and 3W is the delta-connection (triangle connection).

The line voltage generated when the connection state of the coils 3 is the Y-connection is higher than the line voltage generated when the connection state of the coils 3 is the delta-connection, on the assumption that the rotation speed of the motor 1 is the same. The Y-connection corresponds to a first connection state, while the delta-connection corresponds to a second connection state. The connection switching unit 7 switches the connection state of the coils 3U, 3V, and 3W of the motor 1 between the Y-connection as the first connection state and the delta-connection as the second connection state by switching the switching elements 71, 72, and 73.

As illustrated in FIG. 1, the motor 1 has twelve teeth 13, and each of the coils 3U, 3V, and 3W is wound around four teeth 13. That is, the coil 3U illustrated in FIGS. 8(A) and 8(B) is famed of U-phase coil portions wound around four teeth 13 and connected in series. Similarly, the coil 3V is famed of V-phase coil portions wound around four teeth 13 and connected in series. The coil 3W is formed of W-phase coil portions wound around four teeth 13 and connected in series.

(Operation of Air Conditioner)

Figure 9:
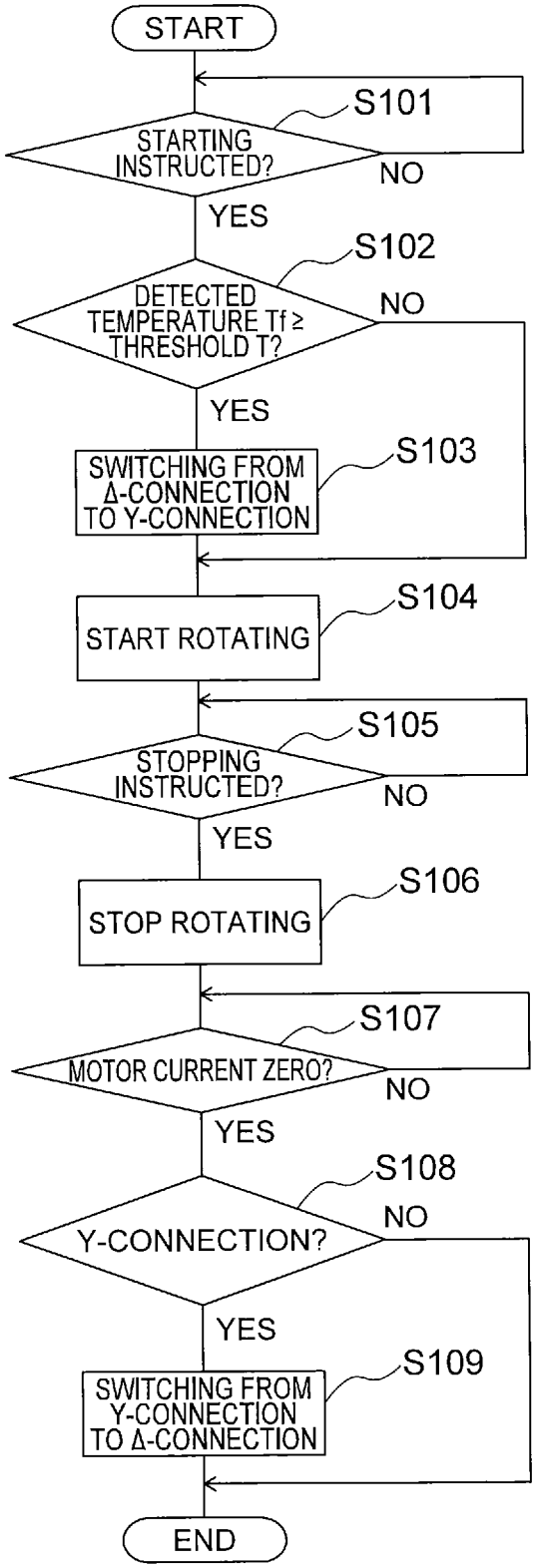
FIG. 9 is a flowchart illustrating an operation of the air conditioner of the first embodiment.

FIG. 9 is a flowchart illustrating the operation of the air conditioner 5 with a focus on the operation of the outdoor unit 5A. The controller 110 of the air conditioner 5 starts the operation when the controller 110 receives a start signal from the remote controller 9 through the signal receiver 108 (step S101). At this stage, the connection state of the coils 3 of the motor 1 in the outdoor fan 4 is the delta-connection as described below.

The controller 110 acquires a surface temperature of the fins 61 (hereinafter referred to as a detected temperature Tf) detected by the fin temperature sensor 65 of the outdoor unit 5A, and determines whether the detected temperature Tf is higher than or equal to a threshold T (step S102). The threshold T is a temperature at which frost formation of the fins 61 may occur, and is, for example, 0° C.

If the detected temperature Tf is higher than or equal to the threshold T, the connection state of the coils 3 of the motor 1 is switched from the delta-connection to the Y-connection (step S103). If the detected temperature Tf is lower than a threshold T, the connection state of the coils 3 of the motor 1 is maintained as the delta-connection.

Thereafter, the controller 110 drives the motor 1 to cause the outdoor fan 4 to start blowing air (step S104). Simultaneously, the controller 110 drives the motor 81 of the indoor fan 8 and a motor of the compressor 51.

Thus, as described with reference to FIG. 2, the refrigerant is discharged from the compressor 51 and then flows through the indoor heat exchanger 52, the expansion valve 53, and the outdoor heat exchanger 6 in this order. The outdoor heat exchanger 6 is supplied with the air blown from the outdoor fan 4, while the indoor heat exchanger 52 is supplied with the air blown from the indoor fan 8.

Each of the motor 1 of the outdoor fan 4 and the motor 81 of the indoor fan 8 rotates at the rotation speed previously set. The controller 110 controls the rotation speed of the motor of the compressor 51 according to a temperature difference between the indoor temperature and the set temperature, but the description thereof is omitted.

When the signal receiver 108 receives a stop signal from the remote controller 9 (step S105), the controller 110 outputs a stop signal to the inverter 103 (step S106).

When the current flowing through the coils 3 of the motor 1 decreases to zero, the motor 1 stops or is brought into a free-run state. When the controller 110 detects that the current is zero (step S107), the controller 110 determines whether the connection state of the coils 3 of the motor 1 is the Y-connection or the delta-connection (step S108).

When the connection state of the coils 3 of the motor 1 is the Y-connection, the controller 110 switches the connection state of the coils 3 to the delta-connection by the connection switching unit 7 (step S109). When the connection state of the coils 3 of the motor 1 is the delta-connection, the controller 110 maintains the connection state of the coils 3 as the delta-connection. Thus, in a state where the motor 1 completely stops, the connection state of the coils 3 is the delta-connection.

When the controller 110 stops the motor 1 in step S106, the controller 110 also stops the motor 81 of the indoor fan 8 and the motor of the compressor 51. Thus, the circulation of the refrigerant in the refrigerant pipe 50 and the blowing of air to the outdoor heat exchanger 6 and the indoor heat exchanger 52 are stopped.

(Action of Air Conditioner)

Next, the action of the air conditioner according to the first embodiment will be described. In general, as the number of turns of the coils 3 of the stator 10 is increased, less current is needed to obtain the required torque. Consequently, the loss due to the energization of the inverter 103 is reduced, and the operation efficiency of the motor 1 is improved. Furthermore, as the number of turns of the coils 3 is increased, the inductance is improved and the iron loss due to carrier harmonics is reduced, so that the motor efficiency is improved.

In the case of the motor 1 used for the outdoor fan 4, if the outside wind causes the impeller 41 to rotate when the motor 1 is not driven, the motor 1 serves as a generator to thereby generate an induced voltage proportional to the rotation speed and the number of turns of the coils 3. Thus, the number of turns of the coils 3 is restricted so that the induced voltage generated by the outside wind does not exceed a withstand voltage of the drive circuit such as the inverter 103. Therefore, an issue is to achieve both the above-described improvement in the operation efficiency of the motor 1 and the suppression of the induced voltage due to the outside wind.

In an environment where the outside temperature is low, there occurs a phenomenon called frost formation, in which moisture in air adheres to the fins 61 of the outdoor heat exchanger 6 and then freezes. When frost formation occurs, the ventilation resistance of the fins 61 increases, and the operation capacity of the outdoor heat exchanger 6 decreases. In order to compensate for the decrease in the operation capacity, it is necessary to increase the rotation speed of the motor 1.

However, if the rotation speed of the motor 1 is increased, the induced voltage increases in proportion to the rotation speed. This increases the motor voltage (line voltage) which is dominated by the induced voltage. The motor voltage cannot exceed the input voltage V (FIG. 5) input to the inverter 103. The input voltage V is determined by the voltage of the power source 101 (the commercial power source), and thus the maximum rotation speed of the motor 1 is restricted. Since the motor voltage is proportional to the number of turns of the coils 3, the maximum rotation speed of the motor 1 decreases as the number of turns of the coils 3 increases. Therefore, an issue is to achieve both the above-described improvement in the operation efficiency of the motor 1 and the suppression of decrease in the operation efficiency of the outdoor heat exchanger 6 due to frost formation.

Figure 10:
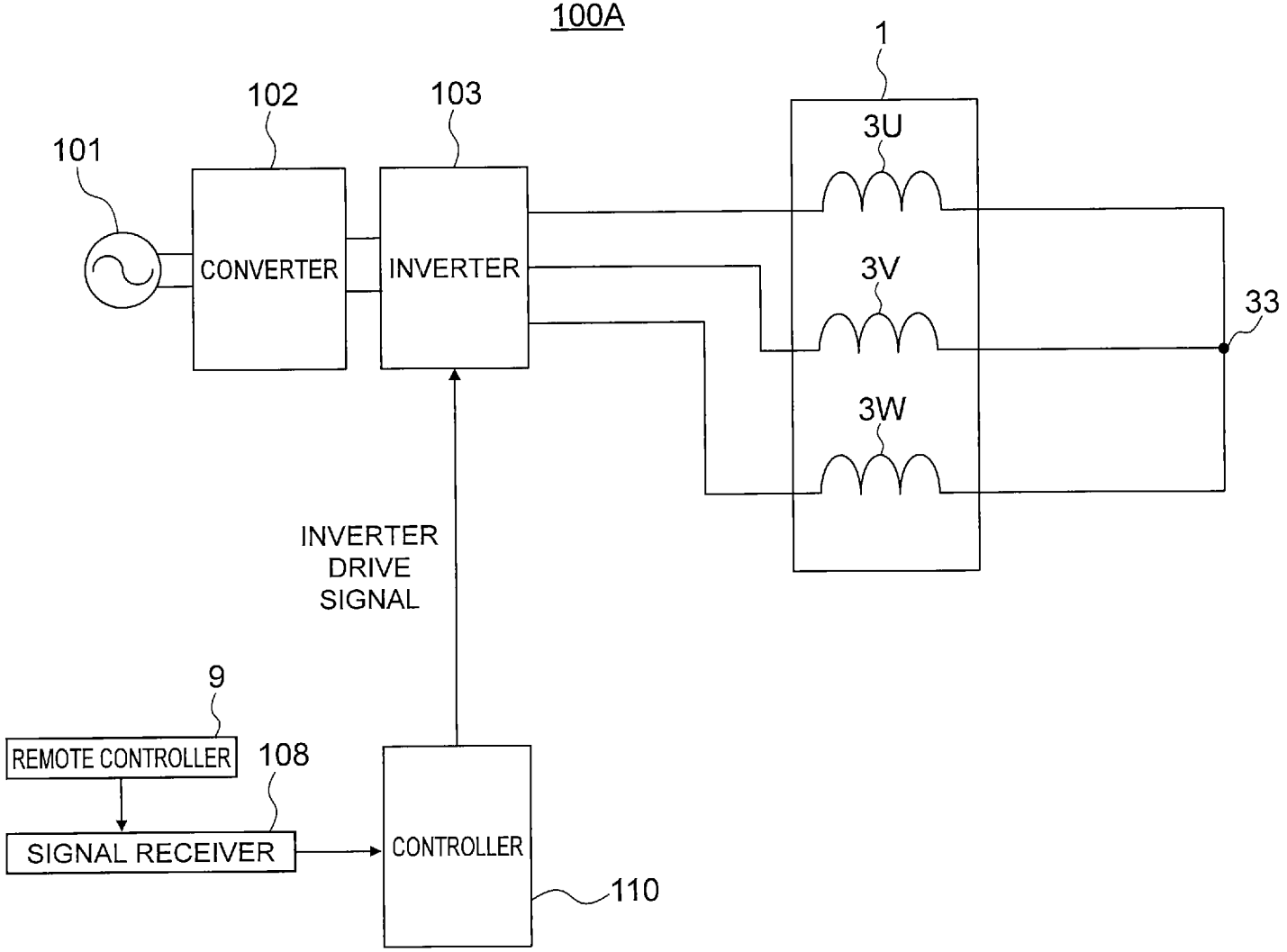
FIG. 10 is a block diagram illustrating a drive device that drives a motor of a comparative example.

Here, a drive device 100A of the motor 1 in an outdoor fan of a comparative example will be described. FIG. 10 is a block diagram illustrating the drive device 100A of the motor 1 in the outdoor fan of the comparative example.

The drive device 100A of the motor 1 in the outdoor fan of the comparative example includes the converter 102, the inverter 103, the signal receiver 108, and the controller 110. The drive device 100A of the comparative example does not includes the connection switching unit 7 (FIG. 6), and the connection state of the coils 3 of the motor 1 is fixed to the Y-connection.

Figure 11:
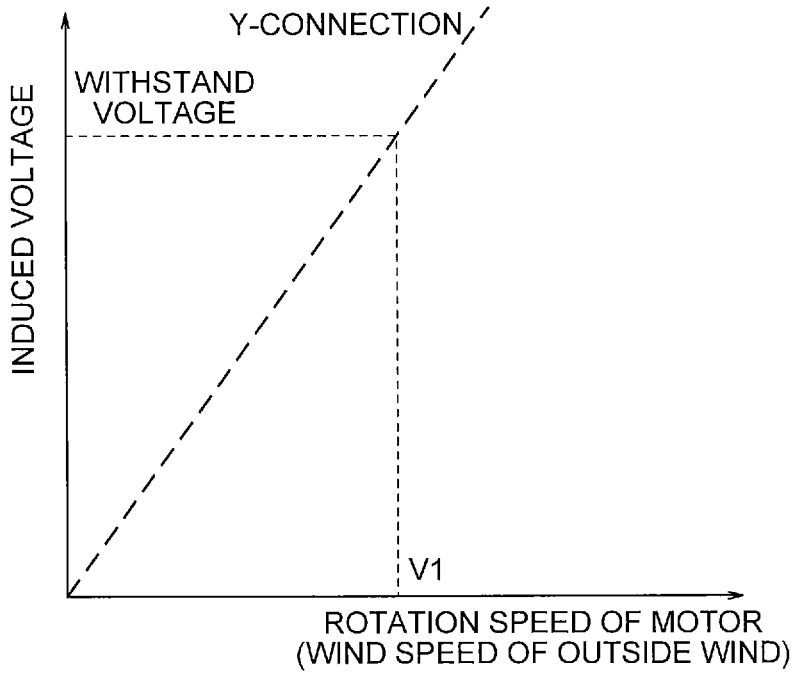
FIG. 11 is a graph illustrating a relationship between a rotation speed of the motor of the comparative example due to the outside wind and an induced voltage.

FIG. 11 is a graph illustrating a relationship between the rotation speed of the motor 1 rotated by the outside wind and the induced voltage generated in the coils 3 of the motor 1 in the outdoor fan of the comparative example. On the assumption that the number of turns of the coils 3 is the same, the induced voltage increases in proportion to the rotation speed of the motor 1, i.e., the wind speed of the outside wind. Therefore, it is necessary to restrict the number of turns of the coils 3 so that the induced voltage does not reach the withstand voltage for the expected wind speed.

Figure 12:
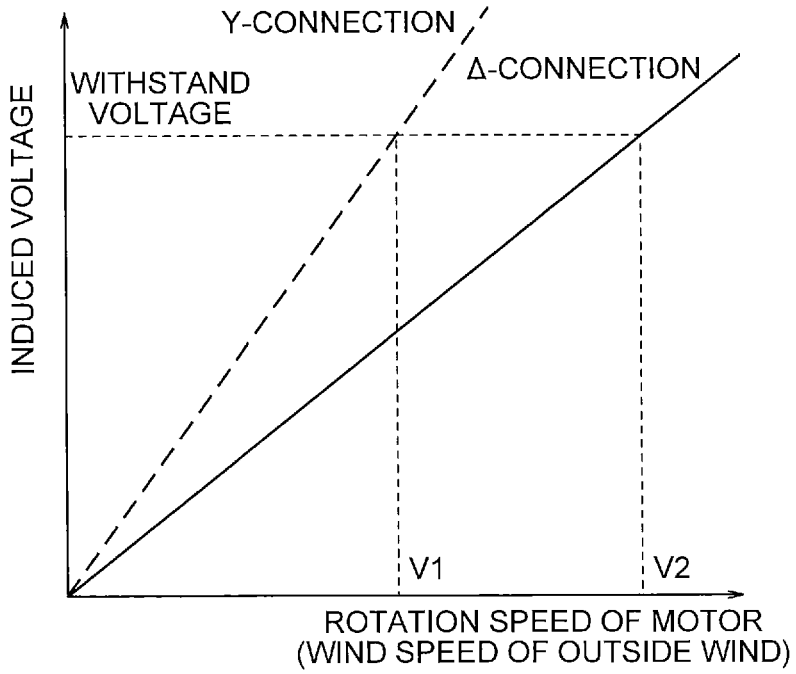
FIG. 12 is a graph illustrating the relationship between the rotation speed of the motor of the first embodiment due to the outside wind and the induced voltage.

FIG. 12 is a graph illustrating a relationship between the rotation speed of the motor 1 rotated by the outside wind and the induced voltage generated in the coils 3 of the motor 1 in the outdoor fan of the first embodiment. As described above, in the first embodiment, the connection switching unit 7 switches the connection state of the coils 3 of the motor 1 between the Y-connection and the delta-connection.

In a case where the connection state of the coils 3 is the delta-connection, the induced voltage generated by the outside wind is $1/\sqrt{3}$ times that in a case where the connection state of the coils 3 is the Y-connection, on the assumption that the wind speed of the outside wind is the same and the number of turns of the coils 3 is the same. Thus, by setting the connection state of the coils 3 to the delta-connection when the motor 1 is not driven, a wind speed V2 of the outside wind at which the induced voltage reaches the withstand voltage is $\sqrt{3}$ times a wind speed V1 in the case where the connection state of the coils 3 is the Y-connection.

That is, by setting the connection state of the coils 3 to the delta-connection when the motor 1 is not driven, it is possible to rotate the motor 1 at a higher speed while ensuring that the induced voltage does not exceed the withstand voltage. Therefore, the number of turns of the coils 3 can be made greater than that of the motor 1 of the comparative example.

Thus, the number of turns of the coils 3 can be increased as described above, and the loss due to the energization of the inverter 103 can be reduced, so that the operation efficiency of the motor 1 can be improved. Furthermore, by increasing the number of turns of the coils 3, the iron loss due to carrier harmonics can be reduced, and thus the motor efficiency can be improved.

Further, when the motor 1 is not driven, the connection state of the coils 3 is set to the delta-connection. Before the motor 1 starts rotating, the detected temperature Tf by the fin temperature sensor 65 is compared with the threshold T. If the detected temperature Tf is higher than or equal to the threshold T, the connection state of the coils 3 is switched to the Y-connection. If the detected temperature Tf is lower than the threshold T, the delta-connection is maintained.

In the case where the connection state of the coils 3 is the delta-connection, the induced voltage generated by the rotation of the motor 1 is $1/\sqrt{3}$ times that in the case where the connection state is the Y-connection, on the assumption that the rotation speed of the motor is the same and the number of turns of the coils 3 is the same. Thus, when the surface temperature of the fins 61 is the temperature at which frost formation occurs, the motor 1 is rotated with the delta-connection. This enables the motor 1 to rotate at a high rotation speed to thereby compensate for the decrease in the operation capacity of the outdoor heat exchanger 6 due to frost formation, while suppressing an increase in the induced voltage.

When the surface temperature of the fins 61 is not the temperature at which frost formation occurs, the motor 1 is rotated with the Y-connection with high efficiency, and thus the operation efficiency of the motor 1 can be improved.

Thus, in the first embodiment, the increase in the induced voltage due to the outside wind can be suppressed, the operation efficiency of the motor 1 can be improved by increasing the number of turns of the coils 3, and the decrease in the operation capacity of the outdoor heat exchanger 6 due to frost formation can be suppressed.

Here, the connection state of the coils 3 is switched based on the surface temperature of the fins 61 (the detected temperature Tf). However, the connection state of the coils 3 may be switched based not only on the surface temperature of the fins 61 but also on any temperature that affects the state of frost formation on the fins 61. For example, the connection state of the coils 3 may be switched based on the temperature of the heat transfer tube 62 or the ambient temperature around the outdoor unit 5A.

Effects of First Embodiment

As described above, the outdoor unit 5A of the first embodiment includes the outdoor heat exchanger 6, the outdoor fan 4 that blows air to the outdoor heat exchanger 6, the connection switching unit 7 that switches the connection state of the coils 3, and the fin temperature sensor 65. When the motor 1 is not driven, the connection switching unit 7 sets the connection state of the coils 3 to the delta-connection. When the motor 1 rotates, the connection switching unit 7 sets the connection state of the coils 3 to the Y-connection if the detected temperature Tf by the fin temperature sensor 65 is higher than or equal to the threshold T, and the connection switching unit 7 sets the connection state of the coils 3 to the delta-connection if the detected temperature Tf is lower than the threshold T. Accordingly, the increase in the induced voltage due to the outside wind when the motor 1 is not driven can be suppressed, the operation efficiency of the motor 1 can be improved by increasing the number of turns of the coils 3, and the decrease in the operation capacity of the outdoor heat exchanger 6 due to frost formation can be suppressed.

Since the fin temperature sensor 65 detects the surface temperature of the fins 61 of the outdoor heat exchanger 6, the connection state of the coils 3 can be switched based on likelihood of the occurrence of frost formation on the fins 61.

The detected temperature Tf is compared with the threshold T before the motor 1 starts rotating, and the connection state of the coils 3 is switched to the Y-connection if the detected temperature Tf is higher than or equal to the threshold T, whereas the connection state of the coils 3 is maintained as the delta-connection if the detected temperature Tf is lower than the threshold T. Thus, the rotation of the motor 1 can be started with the connection state appropriate to the likelihood of the occurrence of frost formation on the fins 61.

In addition, since the connection switching unit 7 switches the connection state of the coils 3 from the Y-connection to the delta-connection before the motor 1 stops, the connection state of the coils 3 can be surely set to the delta-connection when the motor 1 is not driven, and thus the increase in the induced voltage due to the outside wind can be suppressed.

The coils 3 are famed of the three-phase coils, and the connection switching is performed between the Y-connection and the delta-connection. Thus, the delta-connection in which the induced voltage is less likely to increase can be selected in a situation where frost formation is more likely to occur. In other situations, the highly efficient Y-connection can be selected.

According to the operation control method of the first embodiment, the motor 1 is rotated while the connection state of the coils 3 is set to the Y-connection if the detected temperature Tf by the fin temperature sensor 65 is higher than or equal to the threshold T. The motor 1 is rotated while the connection state of the coils 3 is set to the delta-connection if the detected temperature Tf is lower than the threshold T. Before the motor 1 stops, the connection state of the coils 3 is set to the delta-connection. Thus, the increase in the induced voltage due to the outside wind when the motor 1 is not driven can be suppressed, the operation efficiency of the motor 1 can be improved by increasing the number of turns of the coils 3, and the decrease in the operation capacity of the outdoor heat exchanger 6 due to frost formation can be suppressed.

Modification

Next, a modification of the first embodiment will be described. In the above-described first embodiment, the detected temperature Tf by the fin temperature sensor 65 is compared with the threshold T when the motor 1 starts rotating, and the connection state of the coils 3 is selected based on the comparison result.

Meanwhile, after the motor 1 starts rotating, there is a case where the outside temperature increases and the temperature of the fins 61 increases, so that the frost formation is eliminated. Therefore, in this modification, even after the motor 1 starts rotating, the detected temperature Tf by the fin temperature sensor 65 is compared with the threshold T, and the connection state of the coils 3 is selected based on the comparison result.

Figure 13:
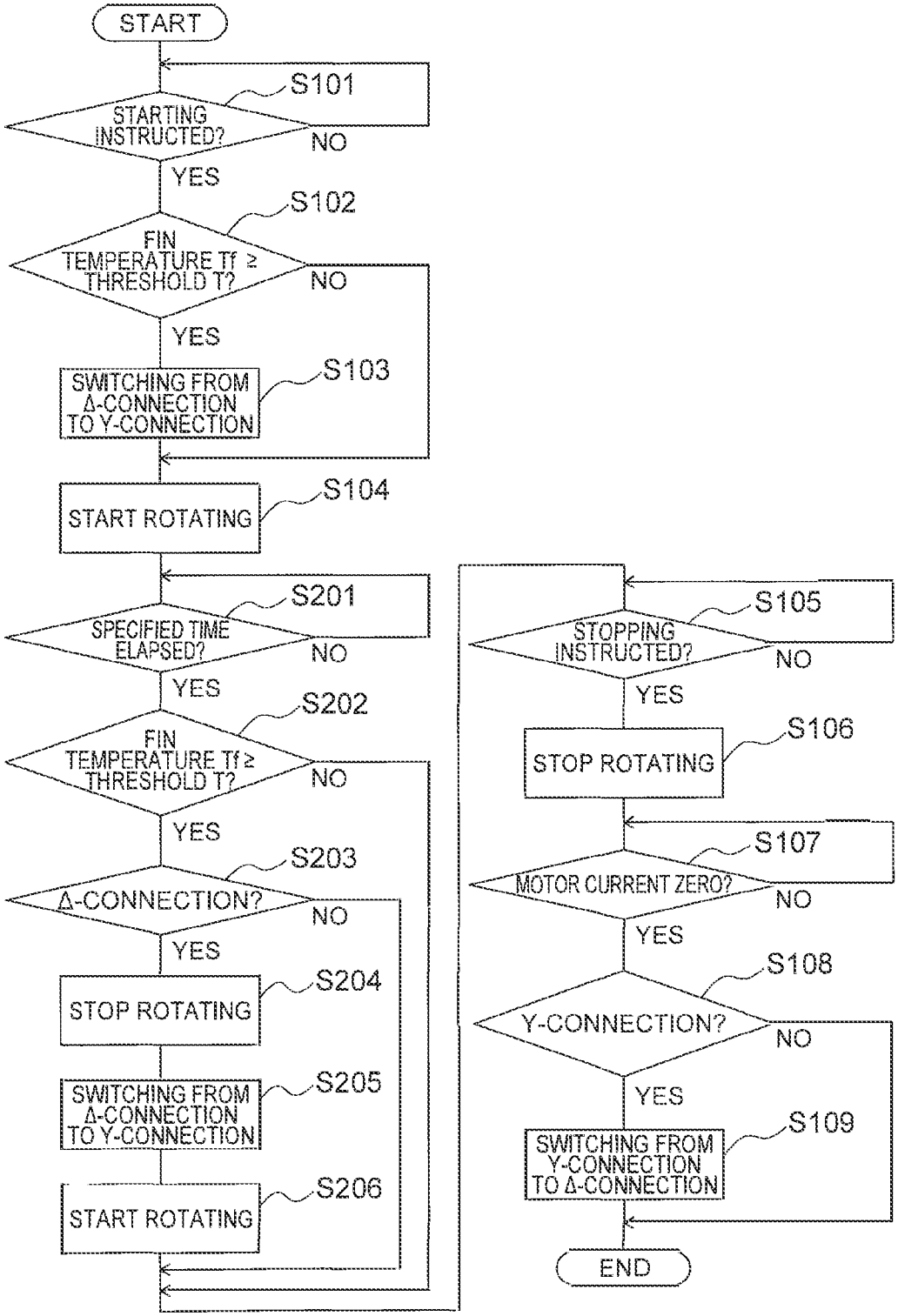
FIG. 13 is a flowchart illustrating an operation of an air conditioner of a modification of the first embodiment.

FIG. 13 is a flowchart for explaining the operation of an air conditioner of the modification of the first embodiment. The processes up to the start of rotation of the motor 1 (steps S101 to S104) are the same as those of the first embodiment.

When an elapsed time from the start of rotation of the motor reaches the specified time (step S201), the controller 110 acquires the surface temperature of the fins 60, i.e., the detected temperature Tf, by the fin temperature sensor 65 and then determines whether the detected temperature Tf is higher than or equal to the threshold T (step S202). The specified time is, for example, one hour, but the specified time is not limited to one hour.

If the detected temperature Tf is higher than or equal to the threshold T, the controller 110 checks the connection state of the coils 3 of the motor 1 (step S203). If the connection state of the coils 3 is the delta-connection, the controller 110 transmits the stop signal to the inverter 103 to thereby stop the rotation of the motor 1 (step S204), and thereafter performs switching to the Y-connection (step S205). After the switching is completed, the rotation of the motor 1 is restarted (step S206). In contrast, if the connection state of the coils 3 is the Y-connection, the connection state is maintained as the Y-connection. The subsequent processes (steps S105 to S109) are as described in the first embodiment.

The reason why the rotation of the motor 1 is temporarily stopped in step S204 is to ensure the reliability of the relay contacts that constitute the switching elements 71, 72, and 73 (FIG. 6) of the connection switching unit 7. If the switching elements 71, 72, and 73 of the connection switching unit 7 are formed of semiconductor switches, it is possible to perform the connection switching while the motor 1 is rotated.

According to this modification, the connection state of the coils 3 is switched to the highly efficient Y-connection when the outside temperature increases and the frost formation is eliminated after the motor 1 starts rotating, and thus the operation efficiency of the motor 1 can be further improved.

Second Embodiment

Figure 14:
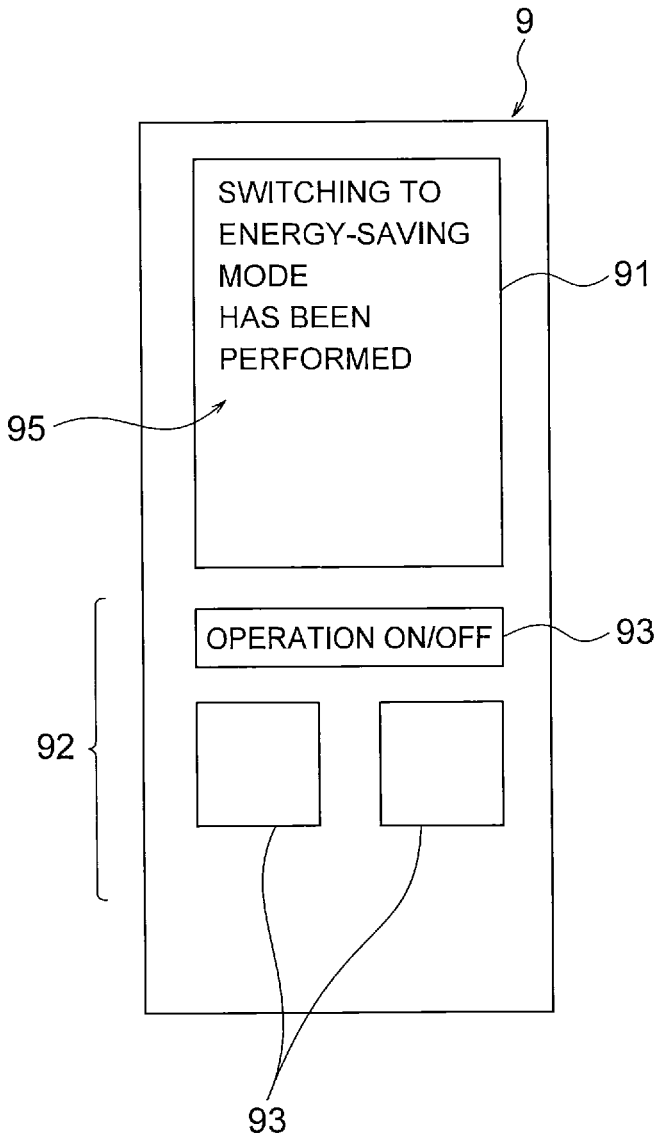
FIG. 14 is a schematic diagram illustrating an example of a display screen of a remote controller in an air conditioner of a second embodiment.

Next, a second embodiment will be described. The second embodiment relates to a display screen of the remote controller 9. FIG. 14 is a schematic diagram of the remote controller 9. The remote controller 9 is an operating device to be used by a user for operating the air conditioner 5 as described in the first embodiment.

The remote controller 9 includes a display 91 and an operation section 92. The operation section 92 has, for example, an on/off switch 93 and setting buttons 94. The display 91 is, for example, a liquid crystal display, and displays an operation state of the air conditioner 5 or a menu screen. The on/off switch 93 is operated when the air conditioner 5 is started and stopped. The setting buttons 94 are portions to change and determine the settings of the operation contents shown on the menu screen of the display 91.

In the above-described first embodiment, the detected temperature Tf of the fins 61 is compared with the threshold T when the motor 1 starts rotating, and then the Y-connection or the delta-connection is selected based on the comparison result. However, the user who starts the air conditioner 5 using the remote controller 9 cannot recognize the connection state of the coils 3 of the motor 1.

Therefore, in the second embodiment, when the connection switching unit 7 switches the connection state of the coils 3 of the motor 1 from the delta-connection to the Y-connection (step S103 in FIG. 9), the controller 110 displays a message indicating that the switching to the Y-connection is performed, on a display screen 95 of the display 91 of the remote controller 9.

Specifically, the message "Switching to Energy Saving Mode Has Been Performed" is displayed on the display screen 95 of the display 91 of the remote controller 9, as illustrated in FIG. 14. This allows the user to recognize that the connection state of the coils 3 of the motor 1 is switched from the delta-connection to the highly efficient Y-connection.

Figure 15:
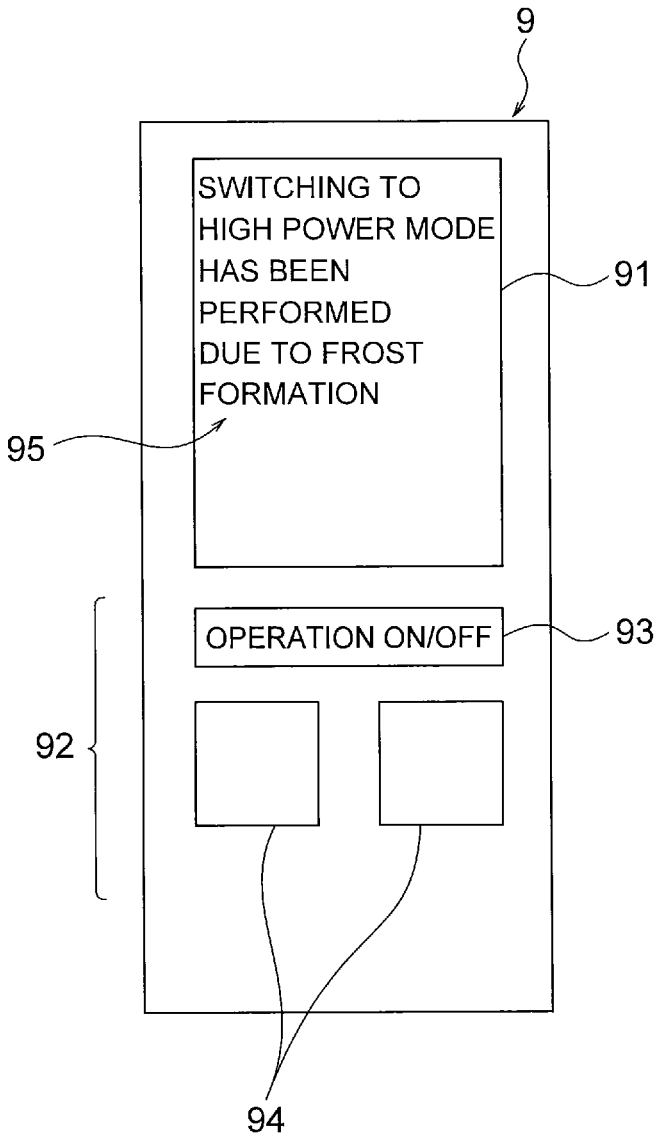
FIG. 15 is a schematic diagram illustrating an example of the display screen of the remote controller in the air conditioner of the second embodiment.

When the motor 1 starts rotating, the connection state of the coils 3 of the motor 1 is maintained as the delta-connection if the detected temperature Tf of the fins 61 is lower than the threshold T, in other words, if the detected temperature Tf is the temperature at which the frost formation occurs. At this time, the message "Switching to High Power Mode Has Been Performed Due to Frost Formation" is displayed on the display screen 95 of the display 91 of the remote controller 9, as illustrated in FIG. 15. This allows the user to recognize that the motor 1 starts rotating while the connection state of the coils 3 is maintained as the delta-connection.

In the modification of the first embodiment, when the rotation of the motor 1 is temporarily stopped for switching the connection state of the coils 3 (step S204 of FIG. 13), the message "Operation Mode Will Be Switched. Temporary Step Will Be Made." is displayed on the display screen 95 of the display 91 of the remote controller 9, as illustrated in FIG. 16.

Figure 16:
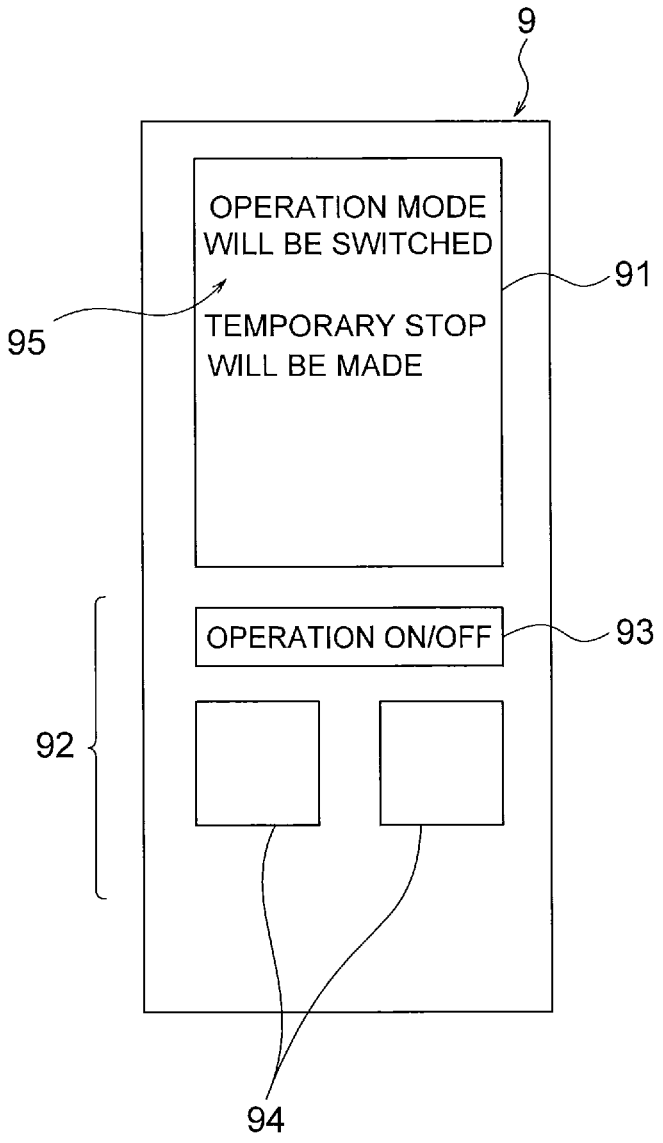
FIG. 16 is a schematic diagram illustrating an example of the display screen of the remote controller in the air conditioner of the second embodiment.

The display examples of the display screen 95 illustrated in FIGS. 14 to 16 are illustrative only and can be changed appropriately.

As described above, in the second embodiment, when the connection switching unit 7 switches the connection state of the coils 3, the message indicating the connection switching is displayed on the display screen 95 of the display 91 of the remote controller 9 which is the operating device. Thus, the user can recognize that the connection state of the coils 3 is switched.

Modification

Next, a modification of the first and second embodiments will be described. In the first and second embodiments described above, the connection state of the coils 3 is switched between the Y-connection and the delta-connection. However, the connection state of the coils 3 may be switched between a series connection and a parallel connection.

Figure 17A:
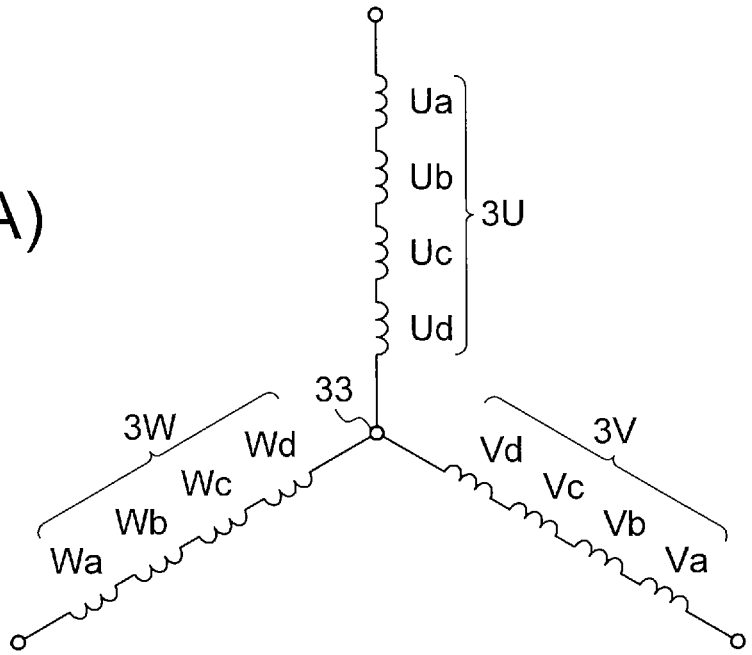
FIGS. 17(A) and 17(B) are schematic diagrams illustrating a switching operation of the connection state of coils of a modification.
Figure 17B:
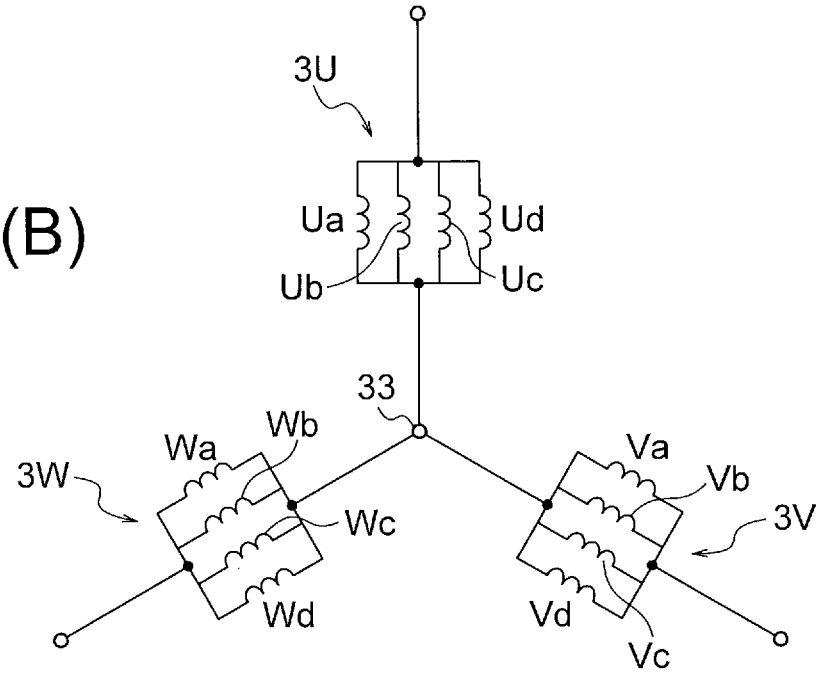

FIGS. 17(A) and 17(B) are schematic diagrams for explaining the switching of the connection state of the coils 3 in the modification.

In FIG. 17(A), the coils 3U, 3V, and 3W are connected in the Y-connection. Coil portions Ua, Ub, Uc, and Ud of the coil 3U are connected in series. Similarly, coil portions Va, Vb, Vc, and Vd of the coil 3V are connected in series, and coil portions Wa, Wb, Wc, and Wd of the coil 3W are connected in series. This connection state corresponds to the first connection state.

In contrast, in FIG. 17(B), the coils 3U, 3V, and 3W are connected in the Y-connection, but the coil portions Ua, Ub, Uc, and Ud of the coil 3U are connected in parallel, the coil portions Va, Vb, Vc, and Vd of the coil 3V are connected in parallel, and the coil portions Wa, Wb, Wc, and Wd of the coil 3W are connected in parallel. In other words, the coil portions of the coil 3 of each phase are connected in parallel. This connection state corresponds to the second connection state.

When the number of coil portions (i.e., the number of rows) of the coil of each phase which are connected in parallel in FIG. 17(B) is represented by "n", the switching from the series connection (FIG. 17(A)) to the parallel connection (FIG. 17(B)) reduces the line voltage by a factor of 1/n. Therefore, when the motor 1 is not driven, an increase in the induced voltage due to the outside wind can be suppressed by setting the connection state of the coils 3 to the connection state illustrated in FIG. 17(B). Meanwhile, "n" is 4 in this example, but only needs to be 2 or more.

The switching of the connection state of the coils 3 illustrated in FIGS. 17(A) and 17(B) can be implemented, for example, by installing selector switches on the coil portions of the coils 3U, 3V, and 3W.

Figure 18A:
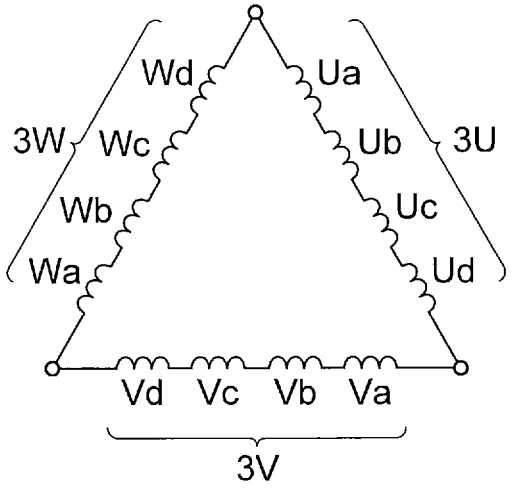
FIGS. 18(A) and 18(B) are schematic diagrams illustrating another example of the switching operation of the connection state of the coils.
Figure 18B:
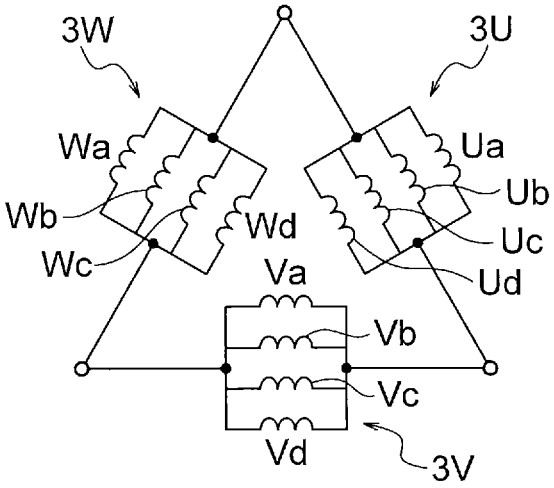

FIGS. 18(A) and 18(B) are schematic diagrams for explaining another configuration example of the modification. In FIG. 18(A), the three-phase coils 3U, 3V, and 3W are connected in the delta-connection. Further, the coil portions Ua, Ub, Uc, and Ud of the coil 3U are connected in series, the coil portions Va, Vb, Vc, and Vd of the coil 3V are connected in series, and the coil portions Wa, Wb, Wc, and Wd of the coil 3W are connected in series. That is, the coil portions of the coil 3 of each phase are connected in series. This connection state corresponds to the first connection state.

In contrast, in FIG. 18(B), the three-phase coils 3U, 3V, and 3W are connected in the delta-connection, but the coil portions Ua, Ub, Uc, and Ud of the coil 3U are connected in parallel, the coil portions Va, Vb, Vc, and Vd of the coil 3V are connected in parallel, and the coil portions Wa, Wb, Wc, and Wd of the coil 3W are connected in parallel. That is, the coil portions of the coil 3 of each phase are connected in parallel. This connection state corresponds to the second connection state.

Also in this case, as described with reference to FIGS. 17(A) and 17(B), the switching from the series connection (FIG. 18(A)) to the parallel connection (FIG. 18(B)) reduces the line voltage by a factor of 1/n. Therefore, when the motor 1 is not driven, an increase in the induced voltage due to the outside wind can be suppressed by setting the connection state of the coils 3 to the connection state illustrated in FIG. 18(B).

The switching of the connection state illustrated in FIGS. 17(A) and 17(B), and the switching of the connection state illustrated in FIGS. 18(A) and 18(B) can provide the same effects as those of the switching between the Y-connection and the delta-connection.

Although the desirable embodiments of the present invention have been specifically described above, the present invention is not limited to the above-described embodiments, and various modifications or changes can be made to those embodiments without departing from the scope of the present invention.

What is claimed is:

1. An outdoor unit comprising:

a heat exchanger;

a fan having a motor having coils, the fan blowing air to the heat exchanger;

a connection switch to switch a connection state of the coils between a first connection state and a second connection state in which a line voltage is lower than a line voltage in the first connection state, wherein the connection switch is between the motor and an inverter; and a temperature sensor to detect a temperature of the heat exchanger, wherein, when the motor is not driven, the connection switch sets the connection state of the coils to the second connection state, and wherein, when the motor rotates, the connection switch sets the connection state of the coils to the first connection state if the detected temperature by the temperature sensor is higher than or equal to a threshold, and the connection switch sets the connection state of the coils to the second connection state if the detected temperature is lower than the threshold, wherein the threshold is a temperature at which frost formation occurs on the heat exchanger.

2. The outdoor unit according to claim 1, wherein the heat exchanger has a fin, and wherein the temperature sensor detects a temperature of the fin of the heat exchanger.

3. The outdoor unit according to claim 1, further comprising a controller, wherein the controller compares the detected temperature with the threshold before the motor starts rotating, and wherein the controller sets the connection state of the coils to the first connection state by the connection switch if the detected temperature is higher than or equal to the threshold, and the controller sets the connection state of the coils to the second connection state by the connection switch if the detected temperature is lower than the threshold.

4. The outdoor unit according to claim 3, wherein the controller further compares the detected temperature with the threshold after the motor starts rotating, and wherein the controller sets the connection state of the coils to the first connection state by the connection switch if the detected temperature is higher than or equal to the threshold, and the controller sets the connection state of the coils to the second connection state by the connection switch if the detected temperature is lower than the threshold.

5. The outdoor unit according to claim 1, wherein, when the motor is to be stopped, the connection switch switches the connection state of the coils from the first connection state to the second connection state, and then the motor is stopped.

6. The outdoor unit according to claim 1, wherein the coils are three-phase coils, and wherein the first connection state is a state in which the three-phase coils are connected in a Y-connection, and the second connection state is a state in which the three-phase coils are connected in a delta-connection.

7. The outdoor unit according to claim 1, wherein the coils are three-phase coils connected in a Y-connection or a delta-connection, wherein the first connection state is a state in which each of the three-phase coils has coil portions connected in series, and wherein the second connection state is a state in which each of the three-phase coils has coil portions connected in parallel.

8. The outdoor unit according claim 1, wherein the connection switch comprises a mechanical switch or a semiconductor switch.

9. The outdoor unit according to claim 1, wherein the motor comprises a rotor that has a rotor core and a permanent magnet attached to the rotor core.

10. The outdoor unit according to claim 1, wherein the motor comprises a stator core, and wherein the coils are wound on the stator core in concentrated winding.

11. An air conditioner comprising:

the outdoor unit according to claim 1; and an indoor unit connected with the outdoor unit via a refrigerant pipe.

12. The air conditioner according to claim 11, further comprising an operating device having a display, wherein, when the connection switch switches the connection state of the coils, the display of the operating device displays information indicating the switching of the connection state of the coils.

13. An operation control method for an air conditioner, the air conditioner comprising an outdoor unit having a heat exchanger, a fan having a motor having coils and blowing air to the heat exchanger, and a temperature sensor to detect a temperature of the heat exchanger, the method comprising:

rotating the motor while setting a connection state of the coils using a connection switch to a first connection state if a detected temperature by the temperature sensor is higher than or equal to a threshold, and setting the connection state of the coils using the connection switch to a second connection state if the detected temperature is lower than the threshold, wherein the connection switch is provided between the motor and an inverter, and the threshold is a temperature at which frost formation occurs on the heat exchanger; and stopping the motor while setting the connection state of the coils to the second connection state.

14. The operation control method for an air conditioner according to claim 13, wherein the air conditioner has an operating device including a display, and wherein, when the connection state of the coils is switched, information indicating the switching of the connection state of the coils is displayed on the display of the operating device.

15. The operation control method for an air conditioner according to claim 14, wherein, when the connection state of the coils is switched from the second connection state to the first connection state, information indicating the switching to the first connection state is displayed on the display of the operating device.

16. The operation control method for an air conditioner according to claim 14, wherein, when the connection state of the coils is switched from the first connection state to the second connection state, information indicating the switching to the second connection state is displayed on the display of the operating device.

17. The operation control method for an air conditioner according to claim 14, wherein, when the connection state of the coils is switched, information indicating a temporary stop of an operation of the air conditioner is displayed on the display of the operating device.

* * * * *